US007399217B1

(12) United States Patent
Godshall

(10) Patent No.: US 7,399,217 B1
(45) Date of Patent: Jul. 15, 2008

(54) LAPPING MACHINE

(75) Inventor: Mark A. Godshall, Mechanicsburg, PA (US)

(73) Assignee: P.R. Hoffman Machine Products, Carlisle, PA (US)

( * ) Notice: Subject to any disclaimer, the term of this patent is extended or adjusted under 35 U.S.C. 154(b) by 0 days.

(21) Appl. No.: 11/671,400

(22) Filed: Feb. 5, 2007

(51) Int. Cl.
*B24B 49/00* (2006.01)

(52) U.S. Cl. ..... 451/11; 451/262; 451/269

(58) Field of Classification Search ..... 451/11, 451/41, 57, 65, 262–271
See application file for complete search history.

(56) References Cited

U.S. PATENT DOCUMENTS

| | | | | |
|---|---|---|---|---|
| 2,618,911 | A | 11/1952 | Indge | |
| 2,839,877 | A | 6/1958 | Boettcher | |
| 2,883,803 | A | 4/1959 | Stead | |
| 2,979,868 | A | 4/1961 | Emeis | |
| 2,992,519 | A | 7/1961 | Pearson | |
| 3,050,910 | A | 8/1962 | Lichtenfeld | |
| 3,111,791 | A | 11/1963 | Harris et al. | |
| 3,374,582 | A | 3/1968 | Boettcher | |
| 3,570,188 | A | 3/1971 | Ebner | |
| 3,631,634 | A | 1/1972 | Weber | |
| 3,699,722 | A | 10/1972 | Davidson et al. | |
| 4,805,348 | A | 2/1989 | Arai et al. | |
| 5,123,218 | A | 6/1992 | Karlsrud | |
| 6,093,087 | A * | 7/2000 | Hakomori et al. | 451/57 |
| 6,280,296 | B1 | 8/2001 | Sato et al. | |
| 6,830,505 | B2 * | 12/2004 | Moriya et al. | 451/262 |
| 6,840,847 | B2 | 1/2005 | Vatterott et al. | |
| 6,932,684 | B1 | 8/2005 | Hunt | |

* cited by examiner

*Primary Examiner*—Dung Van Nguyen
(74) *Attorney, Agent, or Firm*—McNees Wallace & Nurick, LLC

(57) ABSTRACT

A lapping machine includes upper and lower lapping wheels and a sprocket having a common centered rotational axis. A rotational drive source for at least one of the upper and lower lapping wheels provides rotational movement about the axis. At least two independently locatable gears or sprockets disposed radially exterior of the upper and lower lapping wheels rotatably carry a carrier between the upper and lower lapping wheels, in which a material carried within an opening formed in the carrier travels at least partially radially exterior of both lower and upper lapping wheels during operation of the machine.

20 Claims, 6 Drawing Sheets

LAPPING MACHINE

FIELD OF THE INVENTION

The present invention relates generally to lapping machines and, more particularly, to lapping machines capable of accommodating differently sized carriers.

BACKGROUND OF THE INVENTION

Lapping machines, such as lapping machine 10 shown in FIG. 1, typically include at least a ring sprocket 16 having a lower lapping wheel 128 and a center sprocket 12. The ring sprocket 16 has a radius 18 and center sprocket 12 has a radius 14. During operation of lapping machine 10, center sprocket 12 rotates about a center axis 24. Teeth of a carrier 20 mesh with the teeth of ring sprocket 16 and the teeth of center sprocket 12 so that carrier 20 is urged into simultaneous rotational movement about its center axis 26 and planetary movement between radius 14 and radius 18. Carrier 20 includes one or more openings 22 for carrying a work piece 28, such as a disk that is exposed to lower lapping wheel 128 during operation. The diameter 30 of carrier 20 is a fixed distance, equal to the difference between radius 18 of ring sprocket 16 and radius 14 of center sprocket 12. As a result, if a carrier 20 having a diameter greater than diameter 30 is desired, it would be necessary to replace at least one of the center sprocket 12 and ring sprocket 16, which is a costly proposition. In addition, with the construction of lapping machine 10, it is similarly apparent that the maximum size of a disk work piece 28 must be less than diameter 30.

Such known machines suffer from the drawback that to accommodate a larger size carrier, the machine must be significantly enlarged, taking up a similarly increased amount of space in a manufacturing facility, thereby reducing production efficiencies. In addition, storage provisions must be made to store differently sized lapping wheel not in use. Further, in the event larger carriers, even only incrementally larger carriers, can be used for applications previously unknown, these machines lack the flexibility to accommodate the marginally larger carrier, unless further sizable investment in a larger lapping wheel is made.

What is needed is a lapping machine that can accommodate differently sized carriers, and further, can accommodate carriers, and even work pieces, having a dimension greater than the difference between the radius of the ring sprocket and the radius of the center sprocket.

SUMMARY OF THE INVENTION

The present invention relates to a lapping machine including upper and lower lapping wheels and a sprocket having a common centered rotational axis. A rotational drive source for at least one of the upper and lower lapping wheels provides rotational movement about the axis. At least two independently locatable gears or sprockets disposed radially exterior of the upper and lower lapping wheels rotatably carry a carrier between the upper and lower lapping wheels. A material carried within an opening formed in the carrier travels at least partially radially exterior of both lower and upper lapping wheels during operation of the machine.

The present invention further relates to a lapping machine including upper and lower lapping wheels and a sprocket having a common centered axis. A rotational drive source for at least one of the upper and lower lapping wheels provides rotational movement about the axis. At least two independently locatable gears or sprockets are disposed radially exterior of the upper and lower lapping wheels for rotatably carrying a carrier between the upper and lower lapping wheels, in which a work piece composed of a semiconductor material or rigid material carried within an opening formed in the carrier travels at least partially radially exterior of both lower and upper lapping wheels during operation of the machine.

The present invention yet further relates to a lapping machine including upper and lower lapping wheels and a sprocket having a common centered axis. A rotational drive source for at least one of the upper and lower lapping wheels provides rotational movement about the axis. At least two independently locatable idler gears or sprockets are disposed radially exterior of the upper and lower lapping wheels for rotatably carrying a carrier between the upper and lower lapping wheels. The carrier travels at least partially radially exterior of both lower and upper lapping wheels during operation of the machine.

An advantage of the present invention is it can accommodate differently sized carriers.

A further advantage of the present invention is that it can accommodate work pieces larger than the difference between the radii of the center sprocket and the ring sprocket.

A still further advantage of the present invention is that it can accommodate larger work pieces without significantly increasing the footprint of the lapping machine, as compared to prior art lapping machines.

A yet further advantage of the present invention is that it can reduce the number of operating cycles required to produce a predetermined amount of surface area of work pieces.

A still yet further advantage of the present invention is that it can accommodate customized carrier sizes for more efficient manufacturing operations.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 2:
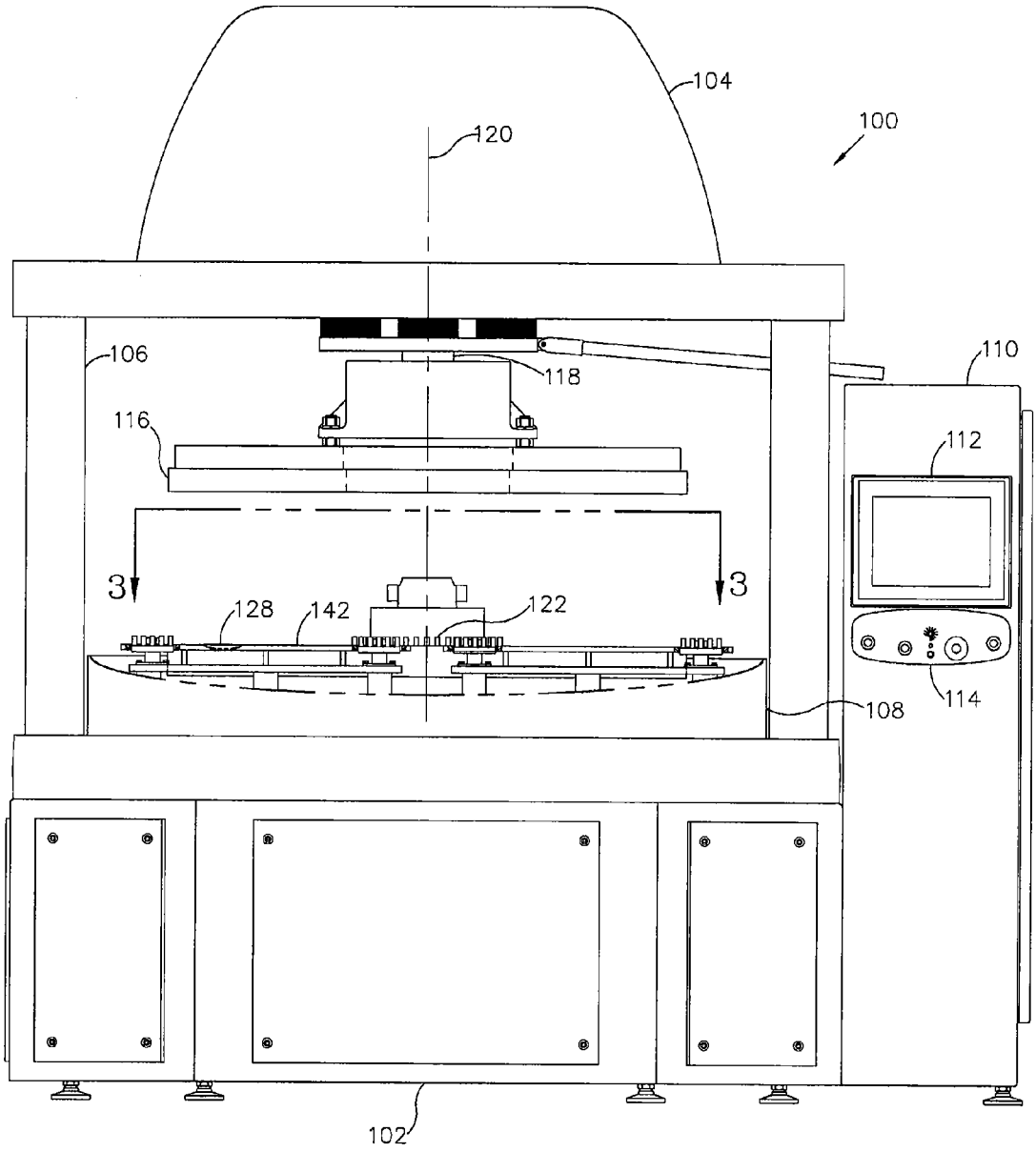
FIG. 2 is a top perspective view of a lapping machine of the present invention.
Figure 3:
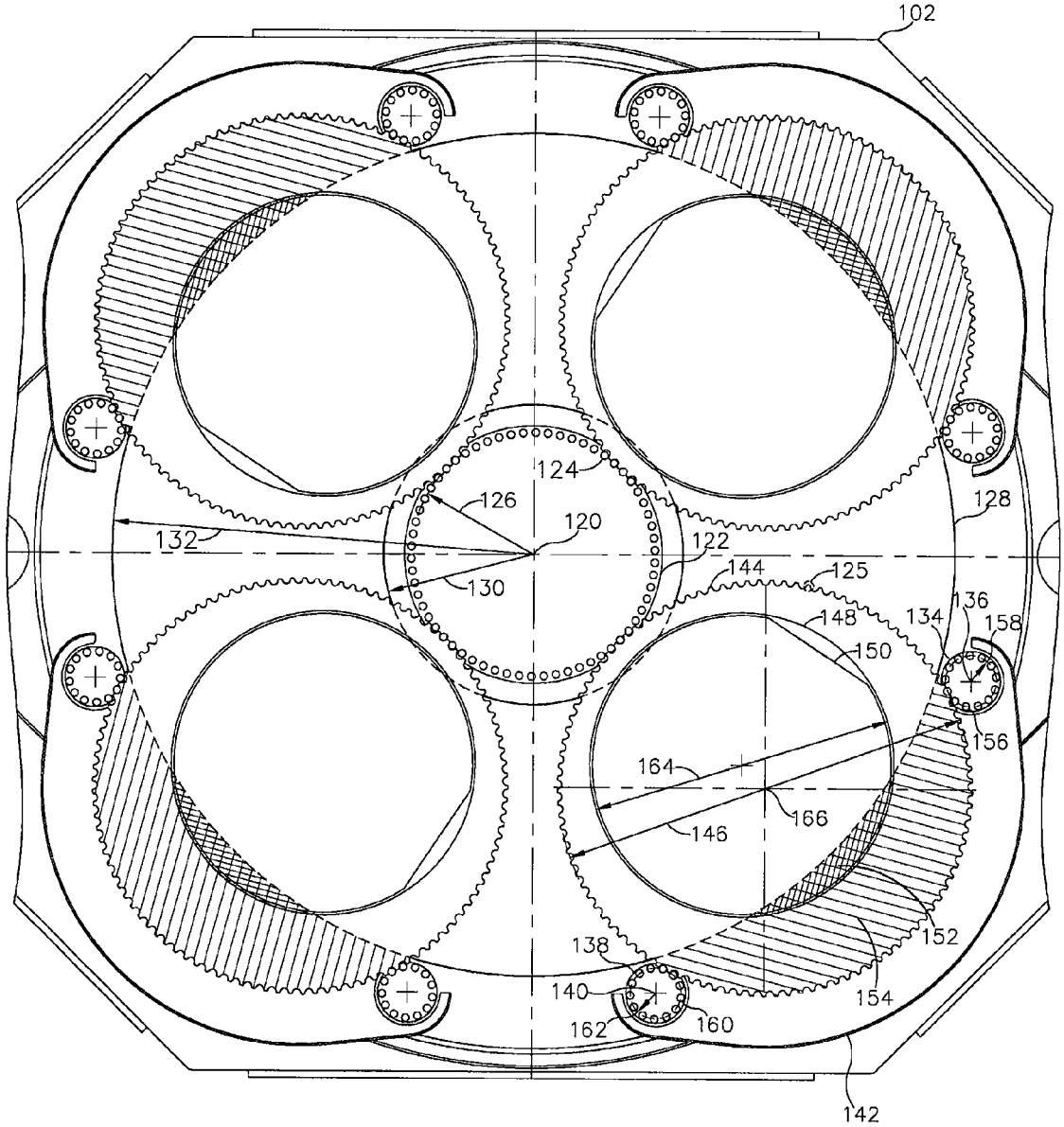
FIG. 3 is a plan view taken along line 3-3 of FIG. 2 of an embodiment of a lapping machine of the present invention.
Figure 4:
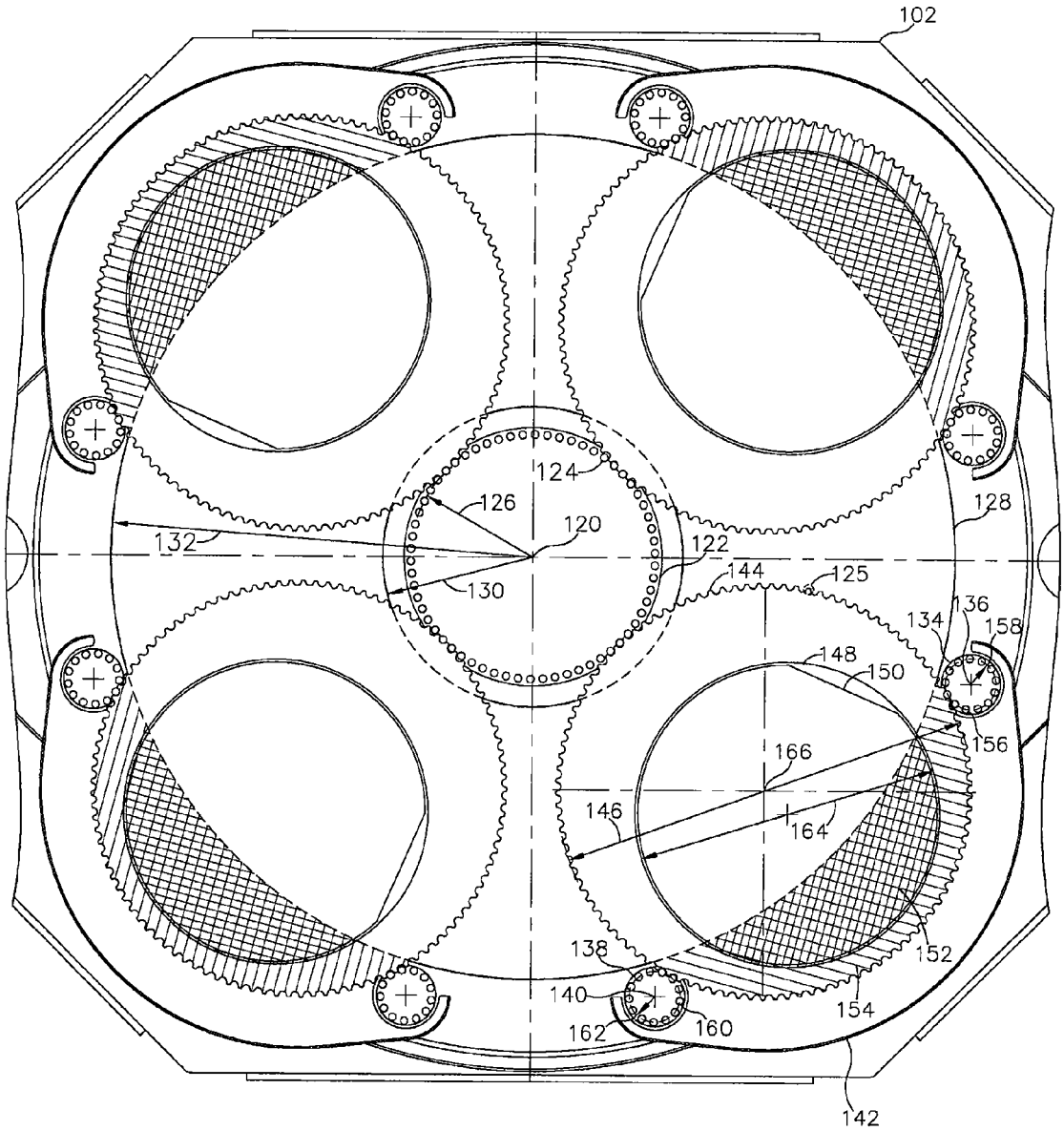
FIG. 4 is a plan view taken along line 3-3 of FIG. 2 of an embodiment of a lapping machine of the present invention with the carrier rotated 180 degrees about its center axis with respect to FIG. 3.

Referring to FIGS. 2-4, a lapping machine 100 (FIG. 2) according to the present invention includes an upper portion 104 that is supported above a lower portion 102 by support columns 106. As shown, an annular base 108 extends outwardly from lower portion 102 toward upper portion 104 and encloses a lower lapping wheel 128 (FIG. 2) and a center sprocket 122 (FIG. 2). An upper lapping wheel 116 extends toward lower lapping wheel 128, upper lapping wheel 116 being rotatably carried by shaft 118 about an axis 120 and selectively raised and lowered with respect to lower lapping wheel 128. In one embodiment, center sprocket 122, upper lapping wheel 116 and lower lapping wheel 128 are centered with respect to axis 120. Controller 110 controls the operations of lapping machine 100 and includes a display device 112 and input device 114. Drive devices (not shown) contained within upper portion 104 and lower portion 102 urge upper lapping wheel 116, lower lapping wheel 128 and center sprocket 122 into an appropriate combination of rotational/translational movement required for efficient operation of lapping machine 100. That is, one or both of upper and lower lapping wheels 116, 128 can rotate, either in the same or opposite directions, and center sprocket 122 can also rotate, if desired. In addition, upper and lower lapping wheels 116, 128 can be selectively directed toward and away from each other during operation of lapping machine 100. As will be discussed in further detail below, lapping machine 100 can accommodate differently sized carriers 144 (FIG. 3).

In one embodiment, center sprocket 122 includes teeth 124 disposed along its periphery, center sprocket 122 having a radius 126 for meshing with corresponding teeth 125 of a carrier 144. As shown in FIG. 3, radius 126 of center sprocket 122 is less than an inner radius 130 of lower lapping wheel 128, with both sprocket 122 and lower lapping wheel 128 concentrically centered along axis 120. Lower lapping wheel 128 has an outer radius 132. Abrasive material (not shown) is disposed along the surface of upper lapping wheel 116 between inner and outer radii 130 and 132. In one embodiment, the inner and outer radii of the upper and lower lapping wheels 116, 128 are substantially the same.

Figure 1:
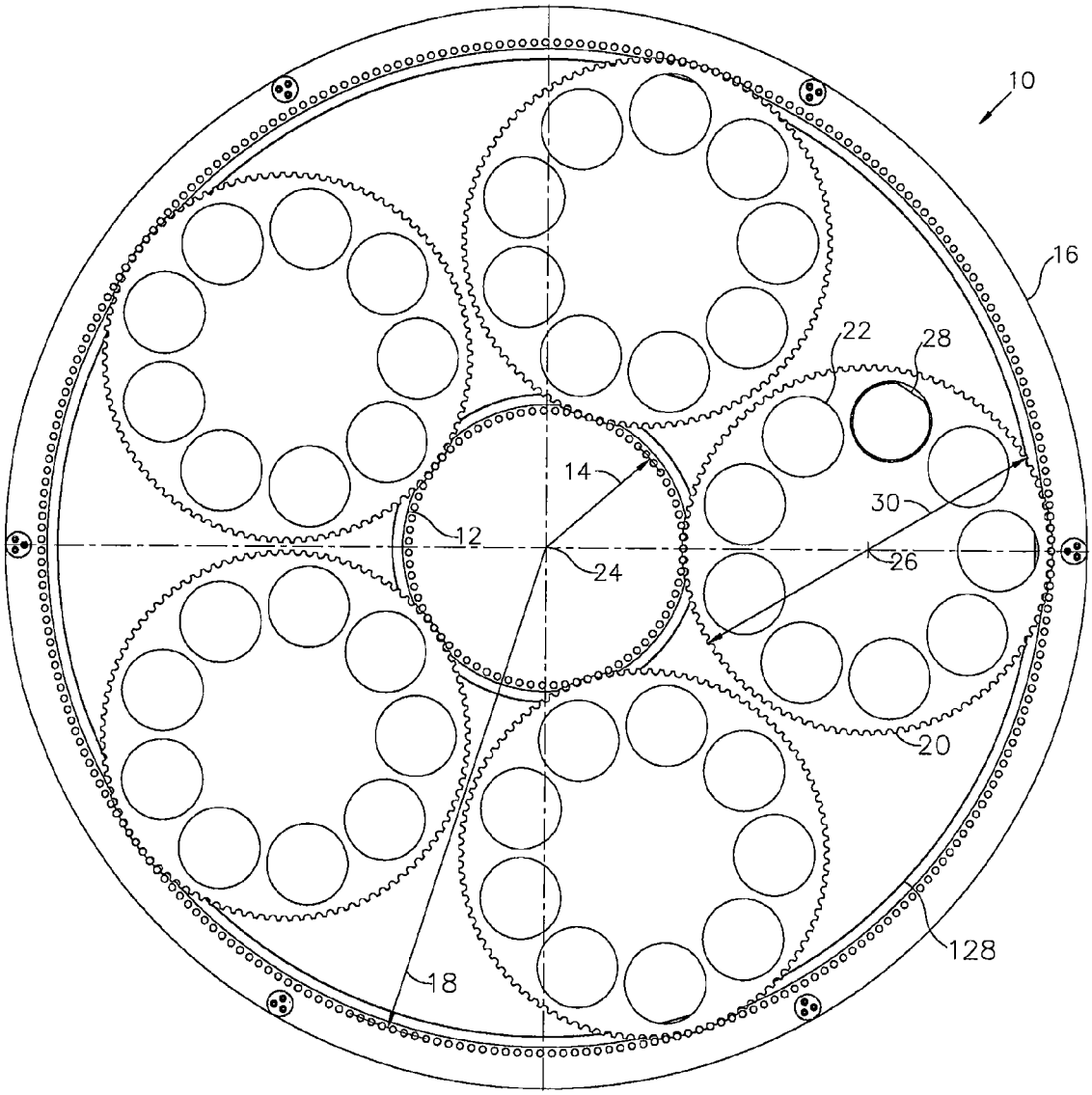
FIGURE 1 PRIOR ART
FIG. 1 is a plan view of a prior art lapping machine.

As further shown in FIG. 3, gear or idler sprocket 134 is rotatably carried about an axis 136 and a gear or idler sprocket 138 is rotatably carried about an axis 140, each axis formed in cradle 142 so that cradle 142 rotatably carries idler sprockets 134, 138. Although not shown in FIG. 3, cradle 142 can contain independently positionable idler sprockets 134, 138 to be rotatably carried about parallel axes along different positions of cradle 142. In another embodiment, cradle 142 is not used, with additional axes (not shown) formed in lower portion 102. In one embodiment, idler sprocket 134 includes teeth 156 peripherally disposed along a radius 158 for meshing with teeth 125 of carrier 144. Similarly, idler sprocket 138 includes teeth 160 peripherally disposed along a radius 162 for meshing with teeth 125 of carrier 144. That is, carrier 144 is rotatably carried by virtue of teeth 156, 160, 124 of respective idler sprockets 134, 138 and center sprocket 122 meshing with teeth 125 of carrier 144. In one embodiment, idler sprockets 134, 138 are not directly associated with driving sources of lower portion 102 (FIG. 1), so that sprockets 134, 138 do not rotatably drive carrier 144. In another embodiment, sprockets 134, 138 are idler gears.

Referring to FIGS. 3 and 4, carrier 144 having a diameter 146 includes an opening 148 that is configured to carry a work piece 150, such as a semiconductor material constructed of silicon, silicon carbide, glass, quartz, metal or ceramic or a combination thereof. However, it is to be understood that semiconductor materials can also be constructed of or include other materials. Further, it is to be understood that work pieces, which are constructed of other suitable rigid materials, can also be used. As shown, carrier 144 includes one opening 148, but it is to be understood that carrier 144 can include more than one opening 148, each configured to carry a work piece 150. In one embodiment, opening 148 is eccentrically disposed with respect to the center 166 of carrier 144. As shown in FIG. 3, work piece 150 has a diameter 164 that is greater than the difference between inner and outer radii 130 and 132 of lower lapping wheel 128. In this embodiment, work piece 150 has an overhang 152 that extends outside of outer radius 132 of lower lapping wheel 128. Similarly, carrier 144 has an overhang 154 that extends outside of outer radius 132 of lower lapping wheel 128.

Overhang 152 as shown in FIG. 3 represents a minimum overhang 152, and that FIG. 4 represents a maximum overhang 152, as carrier 144 is rotated about its center 166, 180 degrees with respect to FIG. 3. The minimum and maximum overhangs 152 correspond with the minimum and maximum extreme positions of work piece 150 with respect to radius 132 of lower lapping wheel 128 due to eccentricity of opening 148, as is appreciated by those skilled in the art. In one embodiment, it is possible to have a maximum overhang of the work piece 150 that is about 33% of the surface area of one side of the work piece 150. However, depending upon the operating parameters of lapping machine 100, including work piece material type, rotational speeds, the amount of compressive forces applied to opposite surfaces of work piece 150 by upper and lower lapping wheels 116, 128, and the shape of work piece 150, it may be possible to increase the previously identified maximum overhang 152.

Lapping machine 100 can accommodate carriers 144 of increased diameter by virtue of locating idler sprockets 134, 138 further outwardly of radius 132, the resulting increase in footprint of lapping machine 100 is minimally increased, if increased at all, compared with prior art lapping machine 10 (see FIG. 1) in which an increase of radius 18 of ring sprocket 16 is required to accommodate carrier 20. In addition, with the ability to selectively locate idler sprockets 134, 138, lapping machine 100 provides flexibility and adaptability to seamlessly accommodate a wide range of carriers 144 and corresponding work pieces 150. It is also to be understood that more than one set of idler sprockets 134, 138 can be used with lapping machine 100, permitting operation with a plurality of differently sized carriers 144 and corresponding work pieces 150. Therefore, not only can lapping machine 100 accommodate larger carriers 144 and work pieces 150 than is possible for similarly sized lapping wheels of prior art lapping machine 10, lapping machine 100 can simultaneously accommodate differently sized, smaller carriers 144 capable of more quickly and efficiently producing work pieces than previously possible.

It is to be understood that although an overhang 152 is always present during operation of lapping machine 100 as shown in FIGS. 3, 4, the relative sizing of carrier 144, opening (s) 148 and work piece 150 dictate the existence of and/or extent of overhang 152.

It is also to be understood that although center sprocket 122 and idler sprockets 134, 138 can be formed of unitary construction, i.e., that teeth 124, 156, 160 are formed by machining a solid disk of material (spur gear design), in another embodiment, teeth 124, 156, 160 can be formed by pins disposed along the periphery so that the pins become the teeth of sprocket 122 and gears 134, 138. That is, the pins can be affixed at a desired radius substantially perpendicular to the respective sprocket 122, 134, 138.

Figure 5:
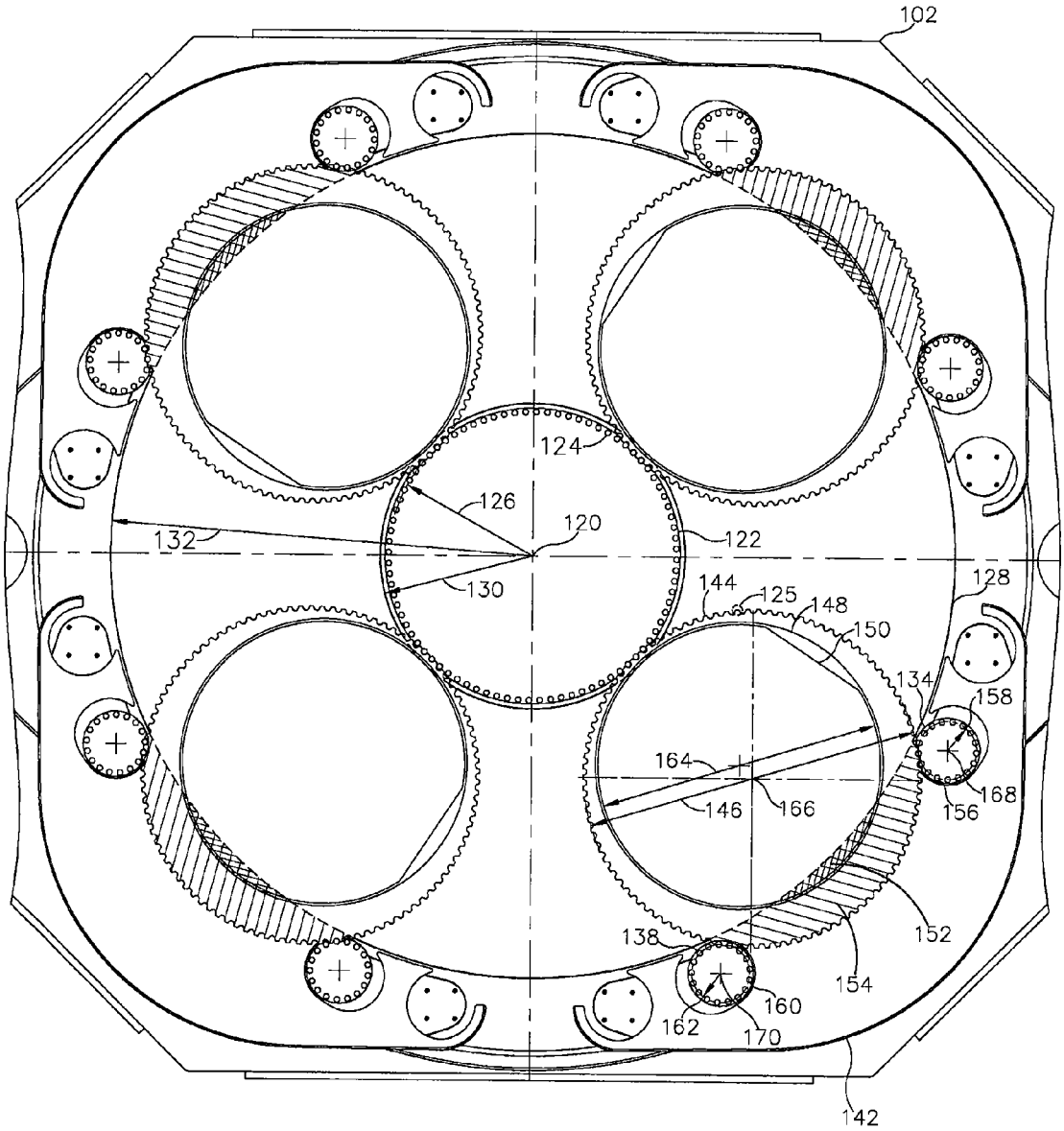
FIG. 5 is a plan view of an embodiment of a lapping machine of the present invention.
Figure 6:
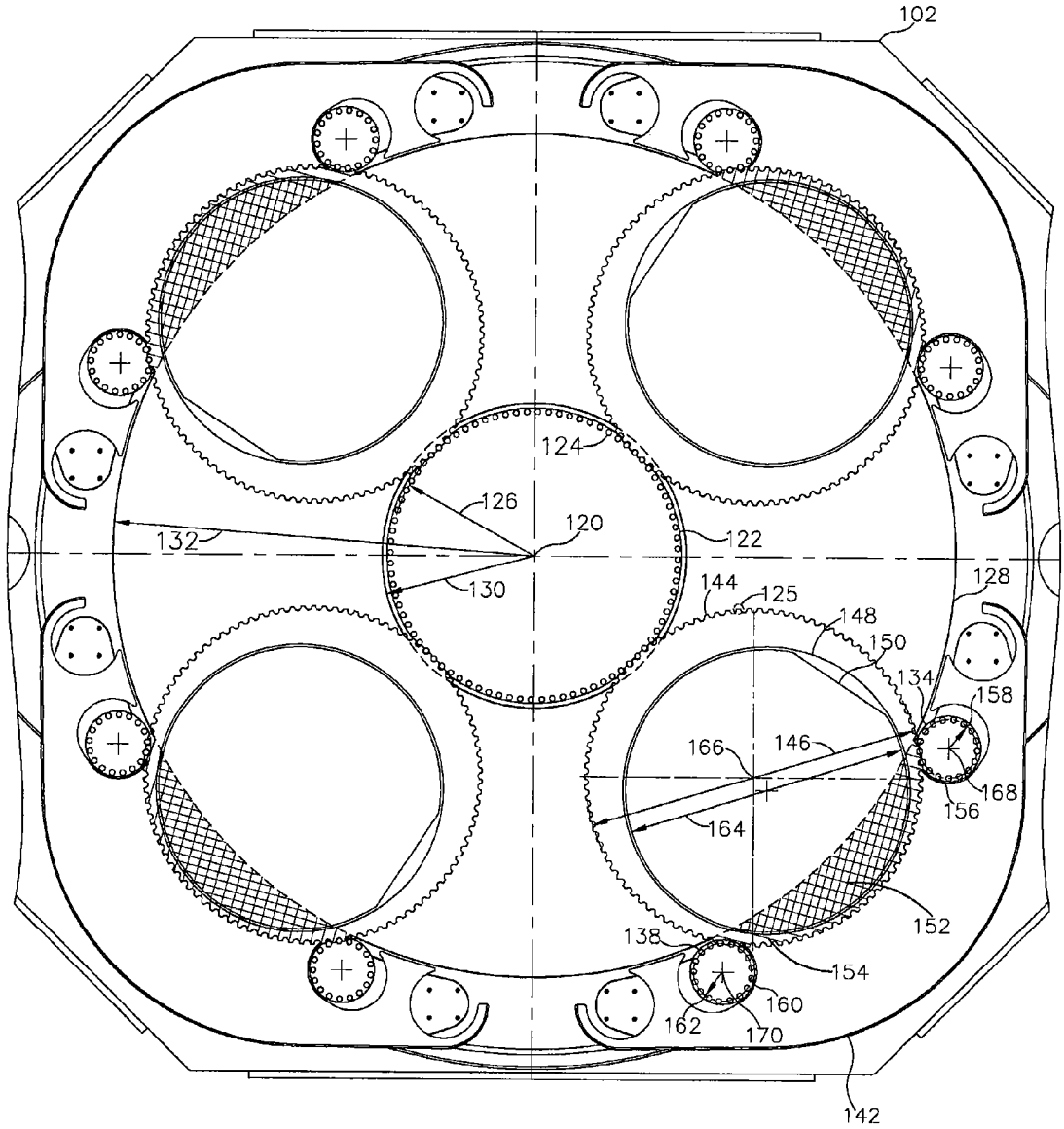
FIG. 6 is a plan view of an embodiment of the lapping machine of FIG. 5 with the carrier rotated an additional 180 degrees of its center axis, of the present invention.

FIGS. 5, 6 shows an embodiment of lapping machine 100 which is otherwise similar to FIGS. 3, 4, except that carrier 144 and center sprocket 122 are sized differently, idler sprockets 134, 138 are thus located at different respective axes 168, 170, and cradle 142 is configured to receive differently sized carriers. It is to be understood that idler sprockets 134, 138 can be positioned at even different axis positions and that gears 134, 138 are not necessarily the same diameter. It is also to be understood that the lapping machine can be configured for use without a cradle, making use of hole patterns formed in the lower portion 102 to receive and secure the idler sprockets to the lower portion 102.

It is to be understood that lapping machine 100 can be used without work pieces 150 installed in carriers 144. That is, in one embodiment, no work piece 150 is placed in any of the carriers 144, so that carriers 144 are exposed to upper and lower lapping wheel 116, 128 during operation of lapping machine 100.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lapping machine comprising:

upper and lower lapping wheels and a sprocket having a common centered rotational axis;

a rotational drive source for at least one of the upper and lower lapping wheels to provide rotational movement about the axis;

at least two independently locatable gears or sprockets disposed radially exterior of the upper and lower lapping wheels for rotatably carrying a carrier between the upper and lower lapping wheels, the at least two gears or sprockets configured to accommodate differently sized carriers, in which a work piece carried within an opening formed in the carrier travels at least partially radially exterior of both lower and upper lapping wheels during operation of the machine.

2. The lapping machine of claim 1 wherein the work piece is composed of a semiconductor material or a rigid material.

3. The lapping machine of claim 1 wherein the carrier includes at least one opening for carrying the work piece.

4. The lapping machine of claim 1 wherein the work piece is selected from the group consisting of silicon, silicon carbide, glass, quartz, metal and ceramic or combination thereof.

5. The lapping machine of claim 1 wherein the at least two independently locatable gears or sprockets are rotatably carried by a cradle.

6. The lapping machine of claim 1 wherein the maximum overhang of the work piece is up to about 33% of the surface area of one side of the work piece.

7. The lapping machine of claim 1 wherein the sprocket and the at least two independently locatable sprockets utilize pins disposed along the periphery.

8. The lapping machine of claim 1 wherein the at least two independently locatable gears or sprockets are idler gears or sprockets.

9. The lapping machine of claim 1 wherein the upper and lower lapping wheels rotate in opposite directions.

10. The lapping machine of claim 1 wherein the sprocket is circular.

11. A lapping machine comprising:

upper and lower lapping wheels and a sprocket having a common centered axis;

a rotational drive source for at least one of the upper and lower lapping wheels to provide rotational movement about the axis;

at least two independently locatable gears or sprockets disposed radially exterior of the upper and lower lapping wheels for rotatably carrying a carrier between the upper and lower lapping wheels, the at least two gears or sprockets configured to accommodate differently sized carriers, in which a work piece composed of a semiconductor material or rigid material carried within an opening formed in the carrier travels at least partially radially exterior of both lower and upper lapping wheels during operation of the machine.

12. The lapping machine of claim 11 wherein the carrier includes at least one opening for carrying the work piece.

13. The lapping machine of claim 11 wherein the work piece is selected from the group consisting of silicon, silicon carbide, glass, quartz, metal and ceramic or combination thereof.

14. The lapping machine of claim 11 wherein the at least two independently locatable gears or sprockets are rotatably carried by a cradle.

15. The lapping machine of claim 11 wherein the maximum overhang of the work piece is about 33% of the surface area of one side of the work piece.

16. The lapping machine of claim 11 wherein the sprocket and the at least two independently locatable sprockets utilize pins disposed along the periphery.

17. The lapping machine of claim 11 wherein the at least two independently locatable gears or sprockets are idler gears or sprockets.

18. The lapping machine of claim 11 wherein the upper and lower lapping wheels rotate in opposite directions.

19. A lapping machine comprising:

upper and lower lapping wheels and a sprocket having a common centered axis;

a rotational drive source for at least one of the upper and lower lapping wheels to provide rotational movement about the axis;

at least two independently locatable idler gears or sprockets disposed radially exterior of the upper and lower lapping wheels for rotatably carrying a carrier between the upper and lower lapping wheels, the at least two gears or sprockets configured to accommodate differently sized carriers, wherein the carrier travels at least partially radially exterior of both lower and upper lapping wheels during operation of the machine.

20. The lapping machine of claim 1 wherein the maximum overhang of the opening of the carrier is up to about 33% of the opening surface area.

* * * * *